US009111494B2

(12) United States Patent
Choi

(10) Patent No.: US 9,111,494 B2
(45) Date of Patent: Aug. 18, 2015

(54) METHOD AND CIRCUIT FOR SYNCHRONIZING INPUT AND OUTPUT SYNCHRONIZATION SIGNALS, BACKLIGHT DRIVER OF LIQUID CRYSTAL DISPLAY DEVICE USING THE SAME AND METHOD FOR DRIVING THE BACKLIGHT DRIVER

(75) Inventor: Yong-Woo Choi, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 187 days.

(21) Appl. No.: 13/572,852

(22) Filed: Aug. 13, 2012

(65) Prior Publication Data

US 2013/0141479 A1 Jun. 6, 2013

(30) Foreign Application Priority Data

Dec. 1, 2011 (KR) ..... 10-2011-0127998

(51) Int. Cl.
*G09G 3/34* (2006.01)
*G09G 5/00* (2006.01)

(52) U.S. Cl.
CPC ..... *G09G 3/3406* (2013.01); *G09G 5/008* (2013.01); *G09G 2310/08* (2013.01); *G09G 2320/0247* (2013.01); *G09G 2320/064* (2013.01); *G09G 2320/0653* (2013.01); *G09G 2340/0435* (2013.01)

(58) Field of Classification Search
CPC ... G09G 3/36; G09G 5/10; G09G 2320/0261; G09G 2330/0261; G06F 3/038
See application file for complete search history.

(56) References Cited

U.S. PATENT DOCUMENTS

| | | | |
|---|---|---|---|
| 2005/0104837 | A1 | 5/2005 | Baik et al. |
| 2005/0110732 | A1 | 5/2005 | Kim |
| 2009/0128479 | A1 | 5/2009 | Yeo et al. |
| 2010/0020004 | A1 | 1/2010 | Smith |
| 2010/0085295 | A1 | 4/2010 | Zhao et al. |
| 2010/0156866 | A1 | 6/2010 | Yeo et al. |

(Continued)

FOREIGN PATENT DOCUMENTS

| | | | |
|---|---|---|---|
| CN | 101441855 | A | 5/2009 |
| CN | 101714342 | A | 5/2010 |
| JP | 2006-091242 | A | 4/2006 |

OTHER PUBLICATIONS

The First Office Action dated Sep. 3, 2014 from the State Intellectual Property Office of the People's Republic of China in counterpart Chinese application No. 201210292726.8.

(Continued)

*Primary Examiner* — Michael Faragalla
(74) *Attorney, Agent, or Firm* — Morgan, Lewis & Bockius LLP

(57) ABSTRACT

Disclosed are method and circuit for synchronizing input and output synchronization signals, which can synchronize an output synchronization signal based on frequency change of an input synchronization signal and limit input and output periods, thereby preventing flickering, a backlight driver of a liquid crystal display device using the same, and a method for driving the backlight driver. The method for synchronizing input and output synchronization signals, includes generating an output synchronization signal whose output period is set based on a comparison result between an input period of an input synchronization signal and a previous output period of the output synchronization signal, and limiting the output period of the output synchronization signal within a predefined limit range from the previous output period.

25 Claims, 12 Drawing Sheets

(56) References Cited

U.S. PATENT DOCUMENTS

| | | | | |
|---|---|---|---|---|
| 2011/0057964 | A1* | 3/2011 | Kanazawa et al. | 345/690 |
| 2011/0316821 | A1* | 12/2011 | Suzuki et al. | 345/204 |
| 2012/0062545 | A1* | 3/2012 | Kim | 345/212 |

OTHER PUBLICATIONS

Office Action dated Jul. 9, 2014 from the Taiwanese Patent Office in counterpart Taiwanese application No. 101129222.

* cited by examiner

METHOD AND CIRCUIT FOR SYNCHRONIZING INPUT AND OUTPUT SYNCHRONIZATION SIGNALS, BACKLIGHT DRIVER OF LIQUID CRYSTAL DISPLAY DEVICE USING THE SAME AND METHOD FOR DRIVING THE BACKLIGHT DRIVER

This application claims the benefit of Korean Patent Application No. 10-2011-0127998, filed Dec. 1, 2011, which is hereby incorporated by reference as if fully set forth herein.

BACKGROUND OF THE INVENTION

1. Field of the Invention

The present invention relates to a method and circuit for synchronizing input and output synchronization signals and more particularly, to a method and circuit for synchronizing input and output synchronization signals, which can synchronize an output synchronization signal based on frequency change of an input synchronization signal and limit input and output periods, thereby preventing flickering, a backlight driver of a liquid crystal display device using the same, and a method for driving the backlight driver.

2. Discussion of the Related Art

Representative examples of flat panel display devices that display images using digital data include Liquid Crystal Display (LCD) devices using liquid crystals, Plasma Display Panels (PDPs) using discharge of inert gas, and Organic Light Emitting Diode (OLED) display devices using OLEDs. Among these, LCD devices have been widely applied to a variety of fields, such as TVs, monitors, laptop computers and cellular phones.

A liquid crystal display device is configured to display images via a matrix of pixels that use electrical and optical properties of liquid crystals having anisotropy, such as refraction and permittivity. Each pixel of the liquid crystal display device performs gradation by adjusting transmittance of light through a polarizing plate via change in the alignment direction of liquid crystals depending on data signals. Such a liquid crystal display device includes a liquid crystal panel to display images via a matrix of pixels, a drive circuit to drive the liquid crystal panel, a backlight unit to irradiate light to the liquid crystal panel, and a backlight driver to drive the backlight unit.

Recently, an LED backlight unit whose light source is light emitting diodes (hereinafter, referred to as LEDs) has been used because LEDs have advantages of more rapid lighting operation, higher brightness and lower power consumption than conventional lamps. The LED backlight unit emits white light generated using white LEDs or a combination of red/green/blue LEDs. Moreover, the LED backlight unit can advantageously perform not only global dimming that controls backlight brightness throughout the backlight unit, but also local dimming that controls backlight brightness on a per position basis, i.e. on a per split block basis.

A backlight driver to drive the LED backlight unit functions to generate a Pulse Width Modulation (PWM) signal having a duty ratio corresponding to a dimming value input from an external system, such as a TV set, or a timing controller, and adjust a turn-on/turn-off time of the LED backlight unit based on the PWM signal to control brightness of the LED backlight unit.

The backlight driver utilizes a Vertical Synchronization (VSYNC) signal that divides a frame of image data input from the external system to synchronize the LED backlight unit with a liquid crystal panel. In this case, to respond to frequency change of the input VSYNC signal, the backlight driver sets an output period by calculating an input period of the VSYNC signal on a per frame basis and generates internal clocks required to generate duty of the PWM signal using the output period of the VSYNC signal.

However, with regard to calculation of the input and output periods of the VSYNC signal on a per frame basis, if sudden frequency change of the VSYNC signal occurs, conventional backlight drivers may fail to set an output period depending on the suddenly changed input period, thereby having difficulty in generating the internal clocks. This causes the duty ratio of a PWM signal to deviate from a desired value. Consequently, the LED backlight unit exhibits brightness fluctuation, thereby suffering from deterioration of image quality, such as occurrence of flickering on a screen.

SUMMARY OF THE INVENTION

Accordingly, the present invention is directed to a method and circuit for synchronizing input and output synchronization signals, a backlight driver of a liquid crystal display device using the same, and a method for driving the backlight driver that substantially obviate one or more problems due to limitations and disadvantages of the related art.

One object of the present invention is to provide a method and circuit for synchronizing input and output synchronization signals, which may generate stabilized internal clocks depending on an output synchronization signal even during an operation of synchronizing input and output synchronization signals based on frequency change of the input synchronization signal, a backlight driver of a liquid crystal display device using the same, and a method for driving the backlight driver.

Another object of the present invention is to provide a method and circuit for synchronizing input and output synchronization signals, which may prevent an output synchronization signal from being suddenly changed due to frequency change of an input synchronization signal, thereby preventing flickering, a backlight driver of a liquid crystal display device using the same, and a method for driving the backlight driver.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for synchronizing input and output synchronization signals, includes generating an output synchronization signal whose output period is set based on a comparison result between an input period of an input synchronization signal and a previous output period of the output synchronization signal, and limiting the output period of the output synchronization signal within a predefined limit range from the previous output period.

The limiting the output period of the output synchronization signal may include comparing the output period with the limit range, maintaining and outputting the output period if the output period is within the limit range, and setting the output period to a minimum value or a maximum value of the limit range to output the set output period if the output period deviates from the limit range.

The limit range of the output period may be preset to "the previous output period±a critical value", and the critical value may be set to be less than the previous output period.

The output period may be set to the minimum value of the limit range and the output period of the minimum value may be output if the output period is less than the limit range, and the output period may be set to the maximum value of the limit range and the output period of the maximum value may be output if the output period is greater than the limit range.

The generating the output synchronization signal may include detecting an $N^{th}$ input period of the input synchronization signal, where N is a positive integer, judging whether or not the detected $N^{th}$ input period is equal to a previous $N-1^{th}$ input period of the output synchronization signal, detecting a difference between an end time of the $N-1^{th}$ output period and an end time of the $N^{th}$ input period if the detected $N^{th}$ input period is not equal to the $N-1^{th}$ output period, performing calculation between the detected difference and the $N^{th}$ input period, and setting the calculated value to an $N^{th}$ output period, and generating and outputting an output synchronization signal having the set $N^{th}$ output period.

After the detecting the $N^{th}$ input period, the method may further include judging whether or not the detected $N^{th}$ input period is within a preset reference range, and generating and outputting an output synchronization signal having the $N-1^{th}$ output period if the $N^{th}$ input period deviates from the reference range, and the method may proceed to the judging whether or not the $N^{th}$ input period is equal to the $N-1^{th}$ output period if the $N^{th}$ input period is within the reference range.

If the $N^{th}$ input period is equal to the $N-1^{th}$ output period, the method may further include setting the $N^{th}$ input period to the $N^{th}$ output period and outputting the $N^{th}$ output period.

The setting the calculated value to the $N^{th}$ output period may include setting a value, obtained by adding the detected difference to the $N^{th}$ input period, to the $N^{th}$ output period if the $N^{th}$ input period becomes greater than the $N-1^{th}$ output period, and setting a value, obtained by subtracting the detected difference from the $N^{th}$ input period, to the $N^{th}$ output period if the $N^{th}$ input period becomes less than the $N-1^{th}$ output period.

The $N^{th}$ input period and the $N^{th}$ output period of the synchronization signals may have a time difference of at least one period.

The input period of the input synchronization signal may be a filtering input period obtained by low pass filtering a plurality of adjacent input periods.

In accordance with another aspect of the invention, a method for synchronizing input and output synchronization signals, includes low pass filtering a plurality of adjacent input periods of an input synchronization signal to output a filtering input period, and generating an output synchronization signal whose output period is set based on a comparison result between the filtering input period and a previous output period of the output synchronization signal.

The filtering input period may be obtained by applying weights to a current input period of the input synchronization signal and a plurality of pervious input periods adjacent to the current input period respectively and summing the results.

In accordance with another aspect of the invention, a circuit for synchronizing input and output synchronization signals, includes an internal synchronization signal generating unit to generate an output synchronization signal whose output period is set based on a comparison result between an input period of an input synchronization signal and a previous output period of the output synchronization signal, and a period limiter to limit the output period of the output synchronization signal within a predefined limit range from the previous output period.

The period limiter may compare the output period with the limit range, may maintain and output the output period if the output period is within the limit range, and may set the output period to a minimum value or a maximum value of the limit range to output the set output period if the output period deviates from the limit range.

The internal synchronization signal generating unit may detect an $N^{th}$ input period of the input synchronization signal, where N is a positive integer, may judge whether or not the detected $N^{th}$ input period is equal to a previous $N-1^{th}$ input period of the output synchronization signal, may detect a difference between an end time of the $N-1^{th}$ output period and an end time of the $N^{th}$ input period if the detected $N^{th}$ input period is not equal to the $N-1^{th}$ output period, may perform calculation between the detected difference and the $N^{th}$ input period, sets the calculated value to an $N^{th}$ output period, and may generate and output the output synchronization signal having the set $N^{th}$ output period.

The internal synchronization signal generating unit may judge whether or not the detected $N^{th}$ input period is within a preset reference range after the detecting the $N^{th}$ input period, and may generate and output the output synchronization signal having the $N-1^{th}$ output period if the $N^{th}$ input period deviates from the reference range, and may judge whether or not the $N^{th}$ input period is equal to the $N-1^{th}$ output period if the $N^{th}$ input period is within the reference range.

The internal synchronization signal generating unit may set the $N^{th}$ input period to the $N^{th}$ output period to output the $N^{th}$ output period if the $N^{th}$ input period is equal to the $N-1^{th}$ output period, may set a value, obtained by adding the detected difference to the $N^{th}$ input period, to the $N^{th}$ output period if the $N^{th}$ input period becomes greater than the $N-1^{th}$ output period, and may set a value, obtained by subtracting the detected difference from the $N^{th}$ input period, to the $N^{th}$ output period if the $N^{th}$ input period becomes less than the $N-1^{th}$ output period.

The circuit for synchronizing input and output synchronization signals may further include a low pass filter to supply the input period, which is a filtering input period obtained by low pass filtering a plurality of adjacent input periods of the input synchronization signal, to the internal synchronization signal generating unit.

In accordance with another aspect of the invention, a circuit for synchronizing input and output synchronization signals, includes a low pass filter to perform low pass filtering of a plurality of adjacent input periods of an input synchronization signal to output a filtering input period, and an internal synchronization signal generating unit to generate an output synchronization signal whose output period is set based on a comparison result between the filtering input period and a previous output period of the output synchronization signal.

The low pass filter may be a finite impulse response (FIR) filter which applies weights to a current input period of the input synchronization signal and a plurality of pervious input periods adjacent to the current input period respectively and summing the results.

In accordance with another aspect of the invention, a method for driving a backlight driver of a liquid crystal display device, includes generating and outputting an output vertical synchronization signal which is synchronized based on change of an input period of an input vertical synchronization signal using the method for synchronizing input and output synchronization signals, generating internal clocks based on an output period of the output vertical synchronization signal, and generating a pulse width modulation signal having a predetermined duty ratio using the internal clocks to drive a backlight unit.

In accordance with a further aspect of the invention, a backlight driver of a liquid crystal display device includes a synchronization circuit to generate and output an output vertical synchronization signal which is synchronized based on change of an input period of an input vertical synchronization signal using the circuit for synchronizing input and output synchronization signals, a clock generating unit to generate internal clocks based on an output period of the output vertical synchronization signal from the synchronization circuit, and a pulse width modulation signal generating unit to generate a pulse width modulation signal having a predetermined duty ratio using the internal clocks to drive a backlight unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
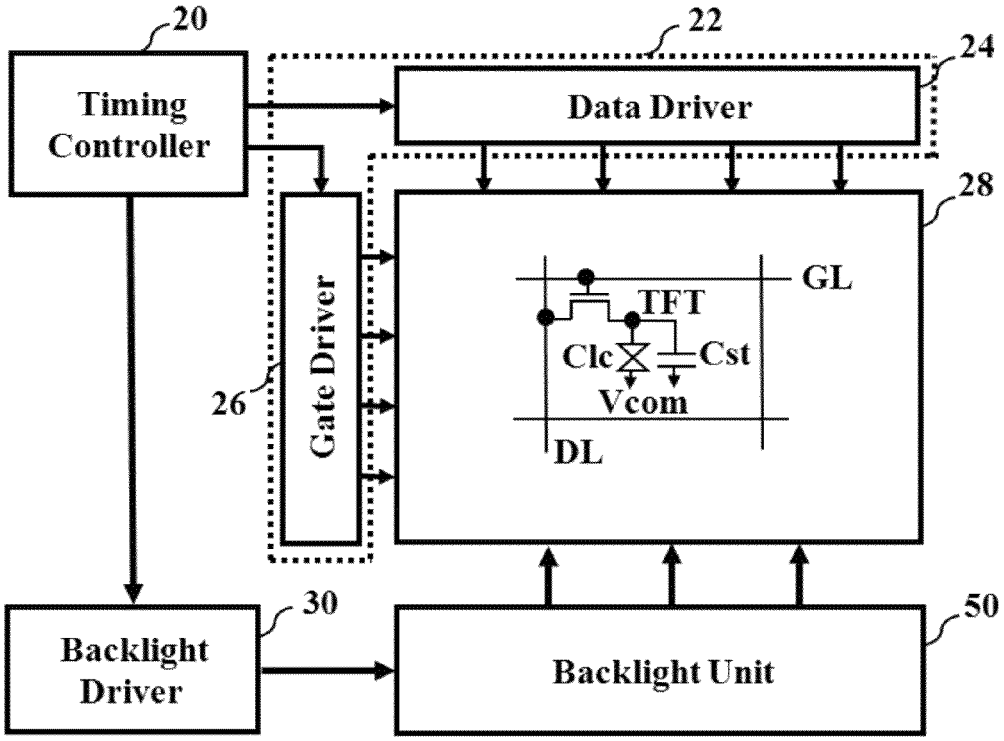
FIG. 1 is a block diagram schematically illustrating a liquid crystal display device according to an embodiment of the present invention.

FIG. 1 is a block diagram schematically illustrating a liquid crystal display device according to an embodiment of the present invention.

The liquid crystal display device illustrated in FIG. 1 includes a liquid crystal panel 28, a backlight unit 50, a panel drive unit 22 including a data driver 24 and a gate driver 26 to drive the liquid crystal panel 28, a backlight driver 30 to drive the backlight unit 50, and a timing controller 20 to control driving of the panel drive unit 22 and the backlight driver 30.

The timing controller 20 functions to correct data input from the outside using a variety of data processing methods for the sake of enhancement in image quality and reduction of power consumption and output the corrected data to the data driver 24 of the panel drive unit 22. For example, assuming that the backlight unit 50 using LEDs is driven by a local dimming method, the timing controller 20 determines a local dimming value, required to control brightness of the backlight unit 50 on a per block basis, via data analysis and compensates for data by reduced brightness via local dimming to output the compensated data. To enhance the response speed of liquid crystals, the timing controller 20 may correct input data into overdriving data using an overshoot value or an undershoot value selected from a look-up table based on a data difference between adjacent frames to output the corrected data. In addition, the timing controller 20 generates data control signals to control driving timing of the data driver 24 and gate control signals to control driving timing of the gate driver 26 using a plurality of synchronization signals input from the outside, i.e. vertical synchronization signals and horizontal synchronization signals, data enable signals and dot clocks. The timing controller 20 outputs the generated data control signals and gate control signals respectively to the data driver 24 and the gate driver 26. The data control signals may include source start pulses and source sampling clocks to control a latch of data signals, polarity control signals to control a polarity of data signals, and source output enable signals to control an output duration of data signals. The gate control signals may include gate start pulses and gate shift clocks to control scanning of gate signals, and gate output enable signals to control an output duration of gate signals.

The panel drive unit 22 includes the data driver 24 to drive a plurality of data lines DL of the liquid crystal panel 28 and the gate driver 26 to drive a plurality of gate lines GL of the liquid crystal panel 28.

The data driver 24 supplies image data from the timing controller 20 to the plurality of data lines DL of the liquid crystal panel 28 in response to the data control signals from the timing controller 20. The data driver 24 converts digital data input from the timing controller 20 into positive polarity/negative polarity analog data signals using a gamma voltage and supplies the data signals to the data lines DL whenever each of the gate lines GL is driven. The data driver 24 takes the form of at least one data Integrated Circuit (IC). Thus, the data driver 24 may be mounted on a circuit film, such as a Tape Carrier Package (TCP), Chip On Film (COF) and Flexible Printed Circuit (FPC) film and may be attached to the liquid crystal panel 28 using a Tape Automatic Bonding (TAB) method, or may be mounted on the liquid crystal panel 28 using a Chip On Glass (COG) method.

The gate driver 26 sequentially drives the plurality of gate lines GL formed at a thin film transistor array of the liquid crystal panel 28 in response to the gate control signals from the timing controller 20. The gate driver 26 supplies a gate on voltage of a scan pulse during every corresponding scan duration of each gate line GL and supplies a gate off voltage during the remaining period for which the other gate lines GL are driven. The gate driver 26 takes the form of at least one gate IC. Thus, the data driver 24 may be mounted on a circuit film, such as a Tape Carrier Package (TCP), Chip On Film (COF) and Flexible Printed Circuit (FPC) film and may be attached to the liquid crystal panel 28 using a Tape Automatic Bonding (TAB) method, or may be mounted on the liquid crystal panel 28 using a Chip On Glass (COG) method. In addition, the gate driver 26 may be embedded in the liquid crystal panel 28 using a Gate In Panel (GIP) method and may be formed on a thin film transistor substrate along with a pixel array.

The liquid crystal panel 28 includes a color filter substrate on which a color filter array is formed, a thin film transistor substrate on which a thin film transistor array is formed, a liquid crystal layer between the color filter substrate and the thin film transistor substrate, and polarizing plates attached respectively to outer surfaces of the color filter substrate and the thin film transistor substrate. The liquid crystal panel 28 displays images via a matrix of a plurality of pixels. Each pixel generates a desired color via a combination of red, green and blue sub pixels that adjust light transmittance by changing alignment of liquid crystals based on data signals. Each sub pixel includes a thin film transistor TFT connected to the corresponding gate line GL and data line DL, and a liquid crystal capacitor Clc and a storage capacitor Cst which are connected in parallel to the thin film transistor TFT. The liquid crystal capacitor Clc is charged with a difference voltage between the data signal supplied to a pixel electrode through the thin film transistor TFT and a common voltage Vcom supplied to a common electrode, and drives liquid crystals using the charged voltage to adjust light transmittance. The storage capacitor Cst assists in stably maintaining the voltage charged to the liquid crystal capacitor Clc. The liquid crystal layer may be driven by a vertical electric field, such as in a Twisted Nematic (TN) mode or a Vertical Alignment (VA) mode, or may be driven by a horizontal electric field, such as in an In-Plane Switching (IPS) mode or a Fringe Field Switching (FFS) mode.

The backlight unit 50 includes a vertical type or edge type LED backlight, which is split-driven into a plurality of blocks by the backlight driver 30 to irradiate light to the liquid crystal panel 28. In the case of the vertical type LED backlight, an LED array is arranged throughout a display region to face the liquid crystal panel 28. In the case of the edge type LED backlight, an LED array is arranged to face at least two edges of a light guide plate that faces the liquid crystal panel 28, such that light irradiated from the LED array is converted into planar light via the light guide plate to thereby be directed to the liquid crystal panel 28.

The backlight driver 30 drives the LED backlight unit 50 on a per LED block basis based on a dimming value from an external system or the timing controller 20, thereby controlling brightness on a per block basis. Assuming that the backlight unit 50 is split-driven into a plurality of port areas, a plurality of backlight drivers 30 may be provided to independently drive the plurality of port areas. The backlight driver 30 drives the backlight unit 50 by generating a Pulse Width Modulation (PWM) signal, which has a duty ratio corresponding to the dimming value, on a per block basis and supplying an LED drive signal corresponding to the generated PWM signal on a per LED block basis. In this case, to synchronize the LED backlight unit 50 with the liquid crystal panel 28, the backlight driver 30 generates the PWM signal using a vertical synchronization signal (hereinafter referred to as "VSYNC"), which is a frame dividing signal input from the external system or the timing controller 20.

In particular, to adaptively respond to frequency change of the input VSYNC, the backlight driver 30 generates and outputs an internal VSYNC whose output period is set based on a comparison result between an input period of the input VSYNC on a per frame basis (on a per period basis) and a previous output period of the internal VSYNC. A method for synchronizing an input VSYNC and an output VSYNC with each other is disclosed in detail in Korean Patent Application No. 10-2010-0140615 (filed on Dec. 31, 2010) by the applicant of the invention.

In the synchronization method disclosed in the prior patent application, to synchronize an input VSYNC and an output VSYNC with each other, the backlight driver 30 detects an input period of an input VSYNC on a per frame basis (on a per period basis), and compares the detected input period with a previous output period of an internal VSYNC. If the input period of the input VSYNC is equal to the previous output period of the internal VSYNC, the backlight driver 30 generates and outputs an internal VSYNC whose output period is equal to the input period (i.e. the previous output period). On the other hand, if the input period of the input VSYNC is not equal to the previous output period of the internal VSYNC, the backlight driver 30 detects a difference between an end time of the input period and an end time of the previous output period (i.e. a time when the previous output period will end), and adjusts the input period by the difference. The backlight driver 30 sets the adjusted input period to an output period, thereby generating and outputting an internal VSYNC having the set output period.

Additionally, to prevent the output period from being suddenly changed due to sudden change in the input period of the input VSYNC, the backlight driver 30 further limits the input period and/or the output period. As a method for limiting the period of the internal VSYNC, the backlight driver 30 adopts a method for limiting a current output period within a predefined range from a previous output period and/or a method for limiting an input period via Finite Impulse Response (FIR) filtering in which weights are applied to a plurality of adjacent input periods to reflect the results in a current input period. In this way, the backlight driver 30 may generate a stabilized internal VSYNC whose output period has a limited change width even if the frequency (period) of an input VSYNC is suddenly changed.

Next, the backlight driver 30 generates internal clocks required to generate duty of a PWM signal based on the output period of the internal (output) VSYNC. The backlight driver 30 generates a PWM signal whose duty ratio is preset or is adjusted based on adjustment of exterior brightness by counting the generated internal clocks, thereby driving the backlight unit 50 using the PWM signal. The PWM signal has the same period as the output period of the internal VSYNC.

As described above, by setting the output period of the internal VSYNC based on the comparison result between the input period of the input VSYNC and the previous output period of the internal VSYNC and limiting the input and output periods within a predefined range, the backlight driver 30 may perform synchronization of the input and output periods even while preventing sudden change of the output period even if the input period is suddenly or repeatedly changed and also, may generate and output a stabilized output synchronization signal even during synchronization. As a result, the backlight driver 30 may prevent omission of internal clocks and synchronization breakage due to frequency change of the input VSYNC, may stably generate the PWM signal having a desired duty ratio, and may prevent flickering.

Meanwhile, to obtain a calculation time required to compare the input period of the input VSYNC and the previous output period of the internal VSYNC, adjust the input period based on the comparison result and utilize the adjusted input period as the output period, the backlight unit 30 generates and outputs the internal VSYNC to make sure that the internal VSYNC has a delay time of about at least one frame (one period) with the input VSYNC.

The backlight unit 30 may additionally perform an operation of comparing the detected input period with a reference range including a preset minimum limit value MIN and a preset maximum limit value MAX, prior to synchronizing the input VSYNC and output VSYNC with each other, namely, prior to comparing the input period of the input VSYNC with the previous output period of the internal VSYNC and then, may selectively perform an operation of synchronizing the input VSYNC and the internal VSYNC with each other based on the comparison result.

For example, if the detected input period of the input VSYNC is within the reference range, the backlight driver 30 compares the input period of the input VSYNC with the previous output period of the internal VSYNC, and precedes synchronization of the input VSYNC and the internal VSYNC based on the comparison result. On the other hand, if the detected input period of the input VSYNC deviates from the reference range, the backlight driver 30 generates and outputs the internal VSYNC that continuously maintains the previous output period without synchronization of the input VSYNC and the internal VSYNC. The reference range with respect to the period of the VSYNC is preset by a designer and is stored in an inner register of the backlight driver 30.

In this way, the backlight driver 30 may generate and output a stabilized internal VSYNC even if the input VSYNC deviates from the reference range and is unstable due to external noise, etc.

Figure 2:
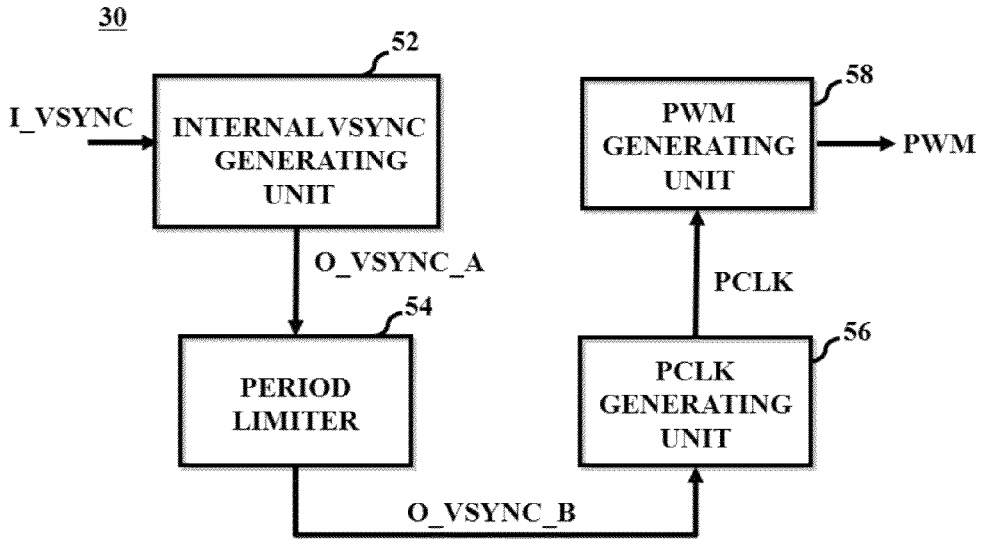
FIG. 2 is a block diagram illustrating an internal configuration of a backlight driver according to a first embodiment of the present invention.
Figure 3:
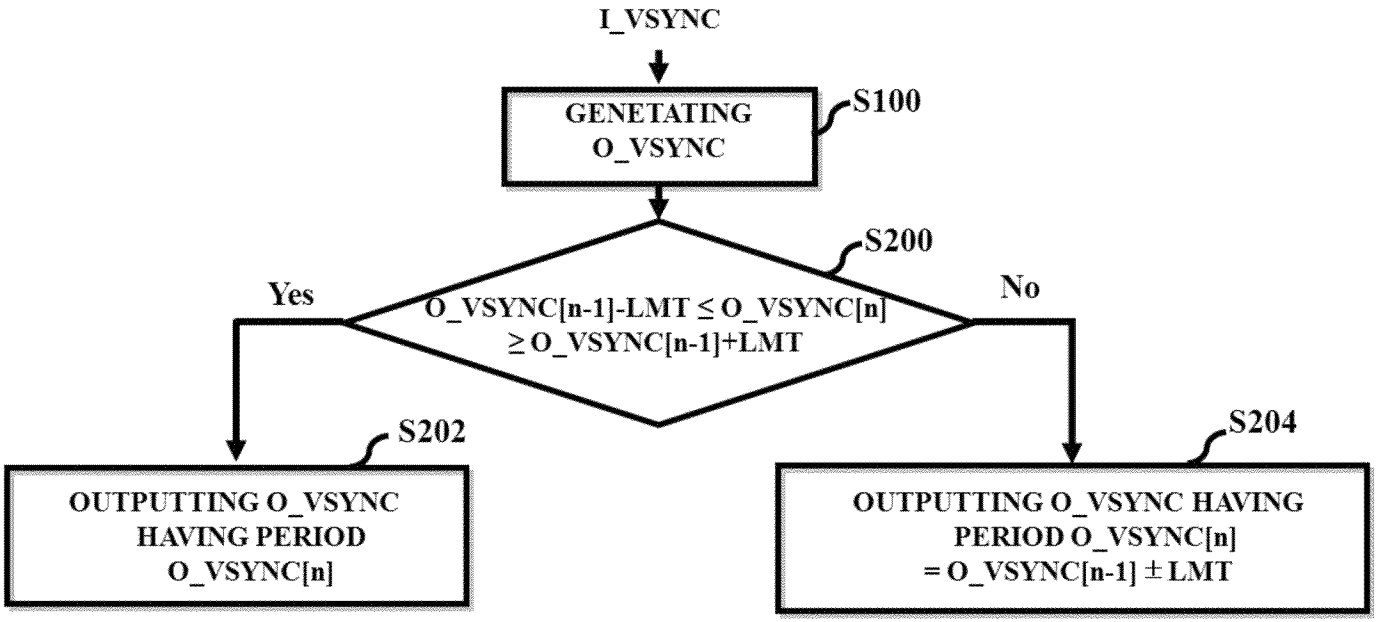
FIG. 3 is a flowchart illustrating the sequence of a method for synchronizing input and output signals of the backlight driver illustrated in FIG. 2.

FIG. 2 is a block diagram illustrating an internal configuration of a backlight driver according to a first embodiment of the present invention, and FIG. 3 is a flowchart illustrating the sequence of a method for synchronizing an input VSYNC and an output VSYNC of the backlight driver illustrated in FIG. 2.

The backlight driver 30 illustrated in FIG. 2 includes an internal VSYNC generating unit 52, a period limiter 54, an internal clock (hereinafter, referred to as PCLK) generating unit 56, and a PWM generating unit 58, which are connected to one another in series.

The internal VSYNC generating unit 52 detects an input period of an input VSYNC I_VSYNC on a per period basis, compares the detected input period with a previous output period, and generates and outputs an internal VSYNC O_VSYNC_A whose output period is set based on the comparison result (S100).

More particularly, the internal VSYNC generating unit 52 detects an input period of an input VSYNC I_VSYNC input from the external system or the timing controller 20, and judges whether or not the detected input period is within a preset period reference range MIN~MAX. If the input period deviates from the reference range MIN~MAX, the internal VSYNC generating unit 52 generates and outputs an internal VSYNC O_VSYNC that maintains a previous output period. If the input period is within the reference range MIN~MAX, the internal VSYNC generating unit 52 judges whether or not the input period is equal to the previous output period. If the input period of the input VSYNC I_VSYNC is equal to the previous output period of the internal VSYNC O_VSYNC, the internal VSYNC generating unit 52 sets the input period of the input VSYNC I_VSYNC to an output period, and generates and outputs an internal VSYNC O_VSYNC_A having the set output period. On the other hand, if the input period of the input VSYNC I_VSYNC is not equal to the previous output period of the internal VSYNC O_VSYNC, the internal VSYNC generating unit 52 detects a difference between an end time of the input period and an end time of the previous output period (i.e. a time when the previous output period will end), sets a value obtained by calculating (adding or subtracting) the detected difference and the input period to an output period, and generates and outputs an internal VSYNC O_VSYNC_A having the set output period.

The period limiter 54 limits the output period of the internal VSYNC O_VSYNC_A supplied from the internal VSYNC generating unit 52 within a predefined range from the previous output period, to output the limited output period (S200 to S204).

More specifically, the period limiter 54 compares a current output period O_VSYNC[n] of the internal VSYNC O_VSYNC with a predefined limit range O_VSYNC[n−1]± LMT from a previous output period O_VSYNC[n−1], where LMT is a critical value (S200). If it is judged that the current output period O_VSYNC[n] is within the limit range O_VSYNC[n−1]±LMT, the period limiter 54 generates and outputs an internal VSYNC O_VSYNC_B having the current output period O_VSYNC[n] (S202). On the other hand, if it is judged that the current output period O_VSYNC[n] of the internal VSYNC O_VSYNC deviates from the limit range O_VSYNC[n−1]±LMT, the period limiter 54 sets the limit range O_VSYNC[n−1]±LMT, i.e. "the previous output period O_VSYNC[n−1]±the critical value LMT" to an output period, and generates and outputs an internal VSYNC O_VSYNC_B having the set output period. If the current output period O_VSYNC[n] is less than the limit range O_VSYNC[n−1]±LMT, the output period is set to "the previous output period O_VSYNC[n−1]−the critical value LMT". On the other hand, if the current output period O_VSYNC[n] is greater than the limit range O_VSYNC[n−1]±LMT, the output period is set to "the previous output period O_VSYNC[n−1]+the critical value LMT". Here, the critical value LMT to limit the output period of the internal VSYNC O_VSYNC is experimentally preset to an appropriate value within the range of the previous output period by a designer and is stored in the inner register. For example, the critical value LMT to limit the output period of the internal VSYNC O_VSYNC may be set within ±10% of the previous output period. The period limiter 54 outputs the internal VSYNC O_VSYNC_B to the PCLK generating unit 56. In addition, if a plurality of backlight drivers is cascade connected, the period limiter 54 may output the internal VSYNC O_VSYNC_B to a backlight driver of a next stage.

The PCLK generating unit 56 generates and outputs internal clocks PCLK based on the output period of the internal VSYNC O_VSYNC_B supplied from the period limiter 54.

The PWM generating unit 58 generates a PWM signal having a duty ratio depending on a dimming value input from the external system or the timing controller 20 using the internal clocks PCLK supplied from the PCLK generating unit 56, and outputs the PWM signal to the backlight unit 50.

Figure 4:
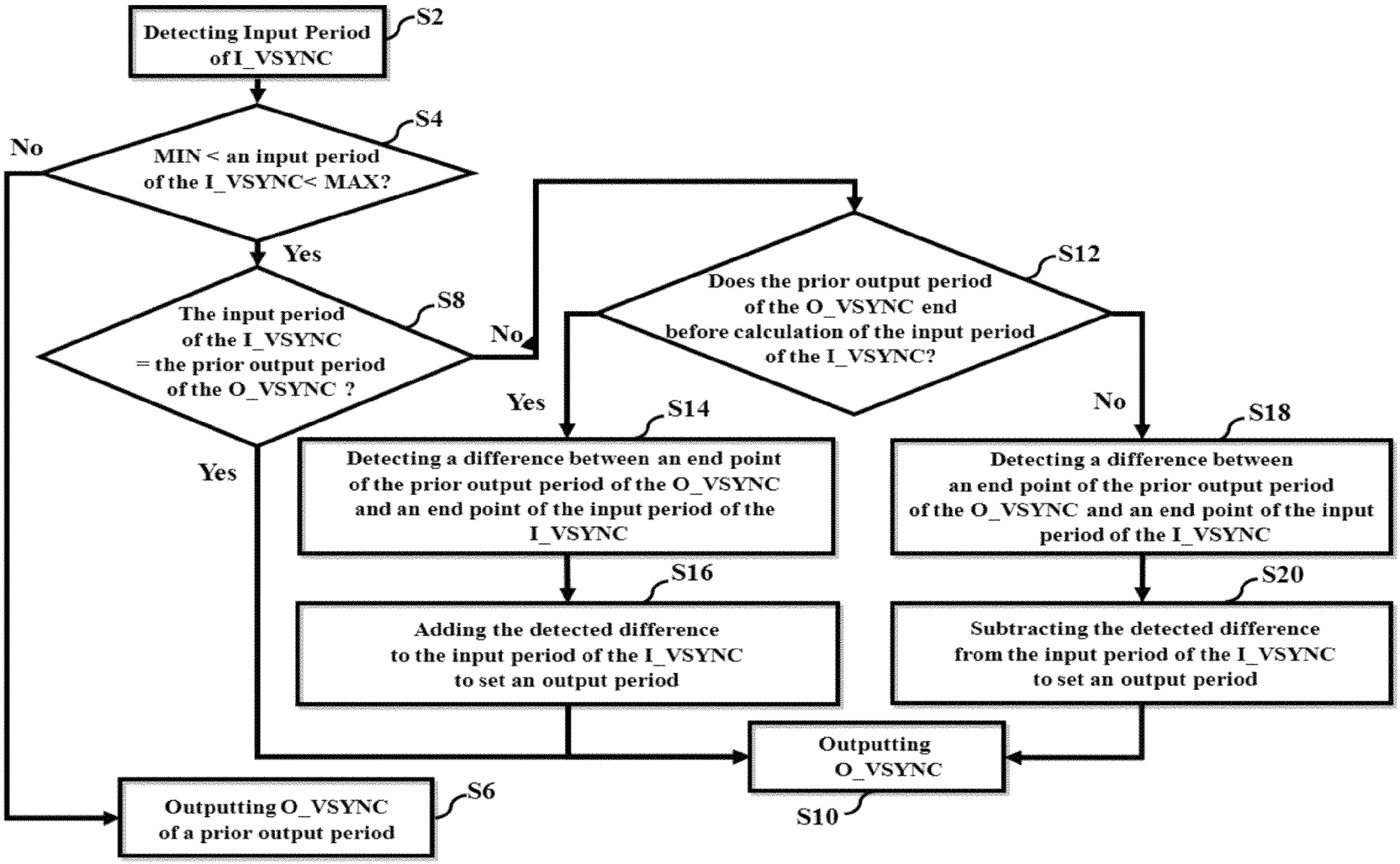
FIG. 4 is a flowchart illustrating an operation of generating an internal vertical synchronization signal illustrated in FIG. 3 in detail.

FIG. 4 is a flowchart illustrating the internal VSYNC generating operation 5100 illustrated in FIG. 3 in detail.

In operation S2, the internal VSYNC generating unit 52 detects a current $N^{th}$ period of an input VSYNC I_VSYNC, where N is a positive integer. The input period of the internal VSYNC I_VSYNC is detected by counting system clocks SCLK generated in the backlight driver 30. The internal VSYNC generating unit 52 stores the detected $N^{th}$ input period in the inner register. The internal VSYNC generating unit 52 detects the input period on a per period basis to update the input period stored in the inner register.

In operation S4, the internal VSYNC generating unit 52 compares the $N^{th}$ input period of the input VSYNC I_VSYNC detected in operation S2 with a preset period reference range MIN~MAX, and judges whether or not the $N^{th}$ input period is within the period reference range MIN~MAX. The period reference range MIN~MAX with respect to the input VSYNC I_VSYNC is preset by a designer to prevent noise, etc. and is stored in the inner register of the backlight driver 30.

If it is judged in operation S4 that the $N^{th}$ input period of the input VSYNC I_VSYNC deviates from the period reference range MIN~MAX (NO), the internal VSYNC generating unit 52 proceeds to operation S6. In operation S6, the internal VSYNC generating unit 52 generates and outputs an $N^{th}$ internal VSYNC O_VSYNC_A whose output period is equal to a previous $N-1^{th}$ output period stored in the inner register. In other words, if it is judged that the $N^{th}$ input period of the input VSYNC I_VSYNC is less than the lower limit value MIN of the reference range MIN~MAX or greater than the upper limit value MAX of the reference range MIN~MAX, the internal VSYNC generating unit 52 sets the previous $N-1^{th}$ output period to an $N^{th}$ output period, thereby stably generating and outputting the $N^{th}$ internal VSYNC O_VSYNC_A. Accordingly, the internal VSYNC generating unit 52 may generate and output the stabilized internal VSYNC O_VSYNC even if the input VSYNC I_VSYNC is unstable due to exterior noise, etc. The internal VSYNC generating unit 52 stores the $N^{th}$ output period of the generated internal VSYNC O_VSYNC_A and utilizes it as a previous period value in the next period.

On the other hand, if it is judged in operation S4 that the $N^{th}$ input period of the input VSYNC I_VSYNC is within the period reference range MIN~MAX (YES), the internal VSYNC generating unit 52 proceeds to operation S8. In operation S8, the internal VSYNC generating unit 52 compares the $N^{th}$ input period of the input VSYNC I_VSYNC stored in the register with the previous $N-1^{th}$ output period of the internal VSYNC O_VSYNC_A, and judges whether or not the $N^{th}$ input period is equal to the previous $N-1^{th}$ output period.

If it is judged in operation S8 that the $N^{th}$ input period of the input VSYNC I_VSYNC is equal to the previous $N-1^{th}$ output period of the internal VSYNC O_VSYNC_A (YES), the internal VSYNC generating unit 52 proceeds to operation S10. In operation S10, the internal VSYNC generating unit 52 sets the $N^{th}$ input period to the $N^{th}$ output period and stores the set $N^{th}$ output period in the inner register. Thereby, the internal VSYNC generating unit 52 generates and outputs the $N^{th}$ internal VSYNC O_VSYNC_A having the stored output period.

On the other hand, if it is judged in operation S8 that the $N^{th}$ input period of the input VSYNC I_VSYNC is not equal to the previous $N-1^{th}$ output period of the internal VSYNC O_VSYNC (NO), the internal VSYNC generating unit 52 proceeds to operation S12. In operation S12, the internal VSYNC generating unit 52 judges whether or not the $N-1^{th}$ output period of the internal VSYNC O_VSYNC ends before the $N^{th}$ input period of the input VSYNC I_VSYNC ends. In other words, the internal VSYNC generating unit 52 judges whether or not the $N^{th}$ input period of the input VSYNC I_VSYNC is greater than the $N-1^{th}$ output period, namely, whether or not the frequency of the input VSYNC I_VSYNC increases.

If it is judged in operation S12 that the previous $N-1^{th}$ output period of the internal VSYNC O_VSYNC_A ends before the $N^{th}$ input period of the input VSYNC I_VSYNC is calculated (ends) (YES), in other words, if the $N^{th}$ input period becomes greater than the $N-1^{th}$ output period (i.e., the frequency of the input VSYNC I_VSYNC increases), the internal VSYNC generating unit 52 proceeds to operation S14. In operation S14, the internal VSYNC generating unit 52 detects a difference between a time when the $N-1^{th}$ output period of the internal VSYNC O_VSYNC_A will end and an end time of the $N^{th}$ input period of the input VSYNC I_VSYNC. Here, the time when the $N-1^{th}$ output period of the internal VSYNC O_VSYNC_A will end is predictable from an $N-1^{th}$ output period value stored in the register.

In operation S16, the internal VSYNC generating unit 52 adds the difference between the time when the $N-1^{th}$ output period of the internal VSYNC O_VSYNC_A will end and the end time of the $N^{th}$ input period of the input VSYNC I_VSYNC, detected in operation S14, to the $N^{th}$ input period, and sets the sum to an $N^{th}$ output period. Then, the internal VSYNC generating unit 52 proceeds to operation S10, thereby generating and outputting an internal VSYNC O_VSYNC_A having the $N^{th}$ output period set in operation S16.

If it is judged in operation S12 that the previous $N-1^{th}$ output period of the internal VSYNC O_VSYNC_A does not end before the $N^{th}$ input period of the input VSYNC I_VSYNC is calculated (ends) (NO), in other words, if the $N^{th}$ input period becomes less than the $N-1^{th}$ output period (i.e., the frequency of the input VSYNC I_VSYNC decreases), the internal VSYNC generating unit 52 proceeds to operation S18. In operation S18, the internal VSYNC generating unit 52 detects a difference between a time when the $N-1^{th}$ output period of the internal VSYNC O_VSYNC_A ended and the end time of the $N^{th}$ input period of the input VSYNC I_VSYNC.

In operation S20, the internal VSYNC generating unit 52 subtracts the difference between the time when the $N-1^{th}$ output period of the internal VSYNC O_VSYNC_A ended and the end time of the $N^{th}$ input period of the input VSYNC I_VSYNC, detected in operation S18, from the $N^{th}$ input period and sets the result to an $N^{th}$ output period. Then, the internal VSYNC generating unit 52 proceeds to operation S10, thereby generating and outputting an internal VSYNC O_VSYNC_A having the $N^{th}$ output period set in operation S20.

Figure 5:
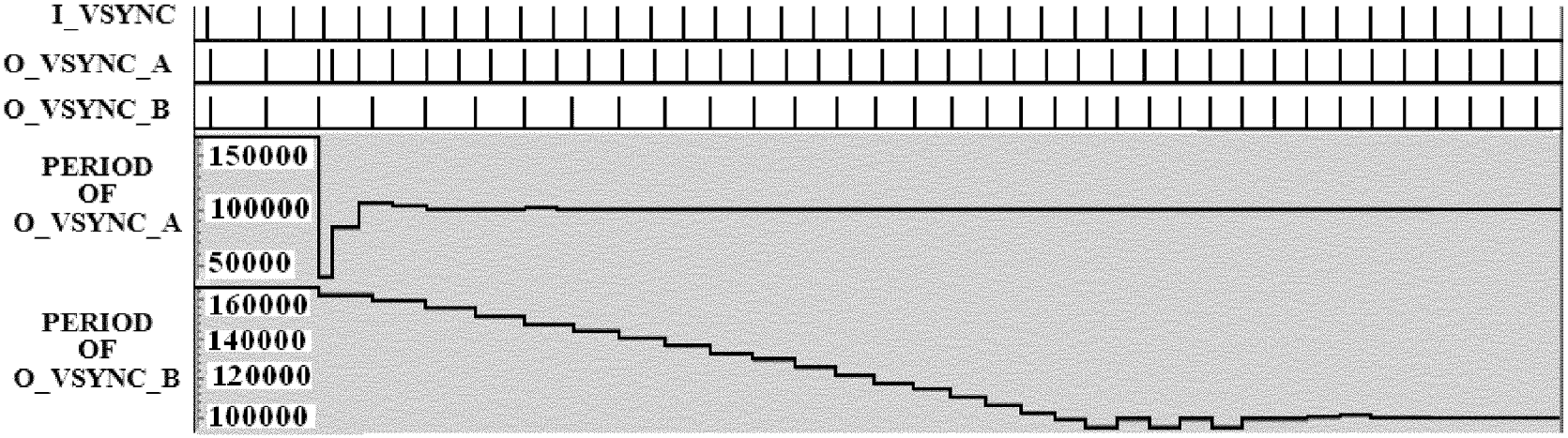
FIG. 5 is a waveform diagram illustrating synchronization of input and output synchronization signals and change of an output period in the case in which the frequency becomes fast in the backlight driver illustrated in FIG. 2.
Figure 6:
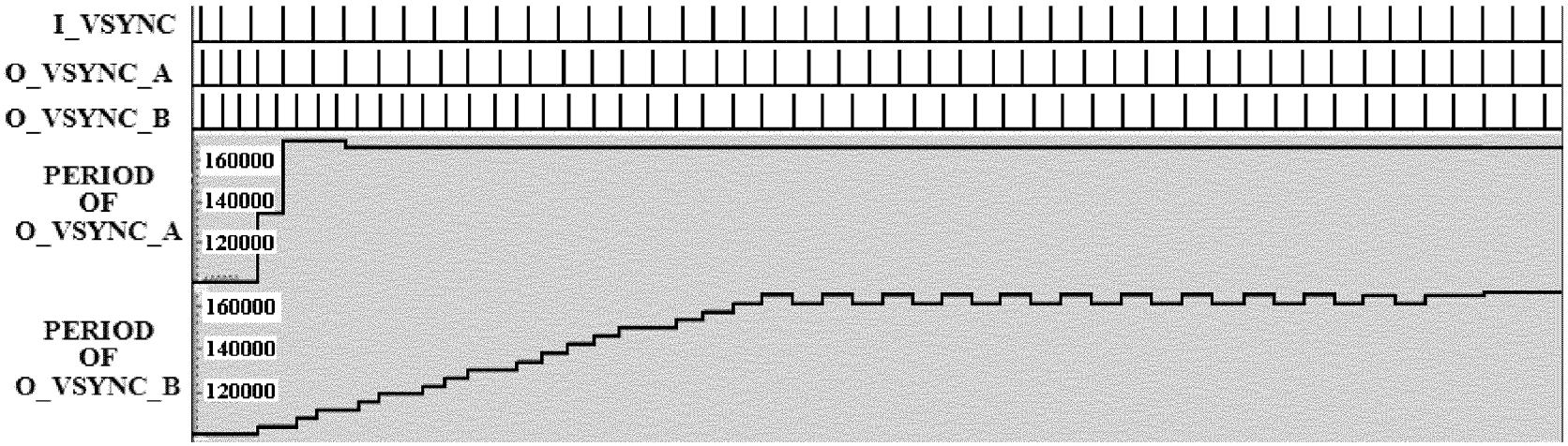
FIG. 6 is a waveform diagram illustrating synchronization of input and output synchronization signals and change of an output period in the case in which the frequency becomes slow in the backlight driver illustrated in FIG. 2.

FIG. 5 is a waveform diagram illustrating synchronization of the input VSYNC and the output VSYNC and change of the output period in the case in which the frequency of the input VSYNC becomes fast in the backlight driver illustrated in FIG. 2, and FIG. 6 is a waveform diagram illustrating synchronization of the input VSYNC and the output VSYNC and change of the output period in the case in which the frequency of the input VSYNC becomes slow in the backlight driver illustrated in FIG. 2.

Referring to FIGS. 5 and 6, it will be appreciated that, although the internal VSYNC O_VSYNC_A generated in the internal VSYNC generating unit 52 rapidly follows the input VSYNC to thereby be synchronized with the input VSYNC when the input VSYNC becomes fast or slow, there is a risk of flickering because the change width of the period is relatively large. On the other hand, it will also be appreciated that, when the period limiter 54 limits the output period within a predefined range from the previous output period, the change width of the period is relatively small although synchronization of the internal VSYNC O_VSYNC_B and the input VSYNC is performed slowly, which may prevent flickering due to sudden change of the period.

Figure 7:
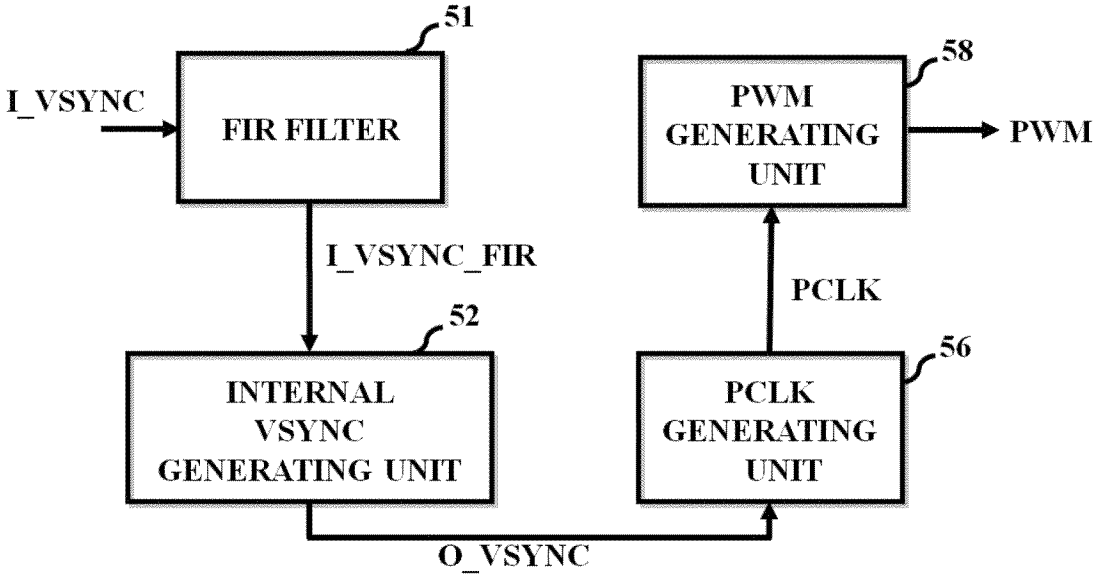
FIG. 7 is a block diagram illustrating an internal configuration of a backlight driver according to a second embodiment of the present invention.
Figure 8:
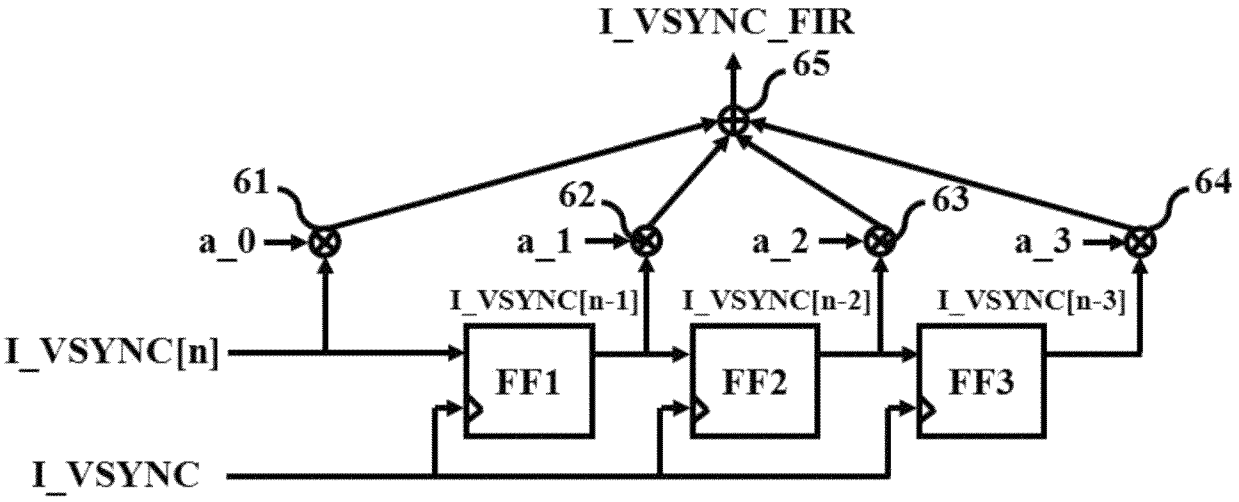
FIG. 8 is a block diagram illustrating an exemplary configuration of an FIR filter illustrated in FIG. 7.

FIG. 7 is a block diagram illustrating an internal configuration of a backlight driver according to a second embodiment of the present invention, and FIG. 8 is a block diagram illustrating an exemplary configuration of an FIR filter 51 illustrated in FIG. 7.

The backlight driver illustrated in FIG. 7 is substantially the same as the backlight driver illustrated in FIG. 2 except that, instead of the period limiter 54, the FIR filter 51 is provided at an input end of the VSYNC generating unit 52 and thus, a detailed description of configurations overlapped with FIG. 2 is omitted.

The FIR filter 51 is a low pass filter. The FIR filter 51 outputs an average value with respect to a plurality of input periods by applying weights to a current input period of an input VSYNC I_VSYNC and a plurality of adjacent previous input periods to reflect the results in the current input period, thereby reducing the change width of the input period. The FIR filter 51 may further effectively reduce the change width of the input period in the case in which the input period of the input VSYNC I_VSYNC is periodically changed.

For example, the FIR filter 51, as illustrated in FIG. 8, includes first to third flip-flops FF1 to FF3 which sequentially delay and output an input period I_VSYNC[n] of an input VSYNC I_VSYNC (where n is a positive integer), first to fourth multipliers 61, 62, 63 and 64 which respectively apply weights a_0, a_1, a_2 and a_3 to the current input period I_VSYNC[n] of the input VSYNC I-VSYNC and previous input periods I_VSYNC[n−1], I_VSYNC[n−2] and I_VSYNC[n−3] output from the first to third flip-flops FF1 to FF3, and an adder 65 which sums the plurality of previous input periods to which the weights have been applied in the first to fourth multipliers 61, 62 63 and 64, to output a filtering input period I_VSYNC_FIR. The filtering input period I_VSYNC_FIR of the input VSYNC I_VSYNC output from the adder 65 is represented as follows:

$$I_VSYNC_FIR = a_0 \times I_VSYNC[n] + a_1 \times I_VSYNC[n-1] + a_2 \times I_VSYNC[n-2] + a_3 \times I_VSYNC[n-3]$$

In the above description, the weights a_0, a_1, a_2 and a_3, which are applied respectively to the current input period I_VSYNC[n] of the input VSYNC I-VSYNC and the plurality of previous input periods I_VSYNC[n−1], I_VSYNC[n−2] and I_VSYNC[n−3], may be preset to be the same, or may be preset to increase or decrease closer to the current input period. In one example, the weights a_0, a_1, a_2 and a_3 may be equally set to ¼. In another example, the weights a_0 and a_1 may be set to ⅛, the weight a_2 may be set to ¼, and the weight a_3 may be set to ½.

The internal VSYNC generating unit 52 compares the filtering input period I_VSYNC_FIR from the FIR filter 51 with a previous output period, and generates and outputs an internal VSYNC O_VSYNC whose output period is set based on the comparison result. A detailed description of this method is replaced by the above description of FIG. 4. Since the internal VSYNC generating unit 52 utilizes the input period I_VSYNC_FIR whose change width is reduced via FIR filtering, it is possible to limit the change width of the output period of the internal VSYNC O_VSYNC, similar to the case of using the period limiter 54 according to the first embodiment.

The PCLK generating unit 56 generates and outputs internal clocks PCLK based on the output period of the internal VSYNC O_VSYNC supplied from the internal VSYNC generating unit 52.

The PWM generating unit 58 generates a PWM signal having a duty ratio depending on a dimming value input from the external system or the timing controller 20 using the internal clocks PCLK supplied from the PCLK generating unit 56, and outputs the PWM signal to the backlight unit 50.

Figure 9:
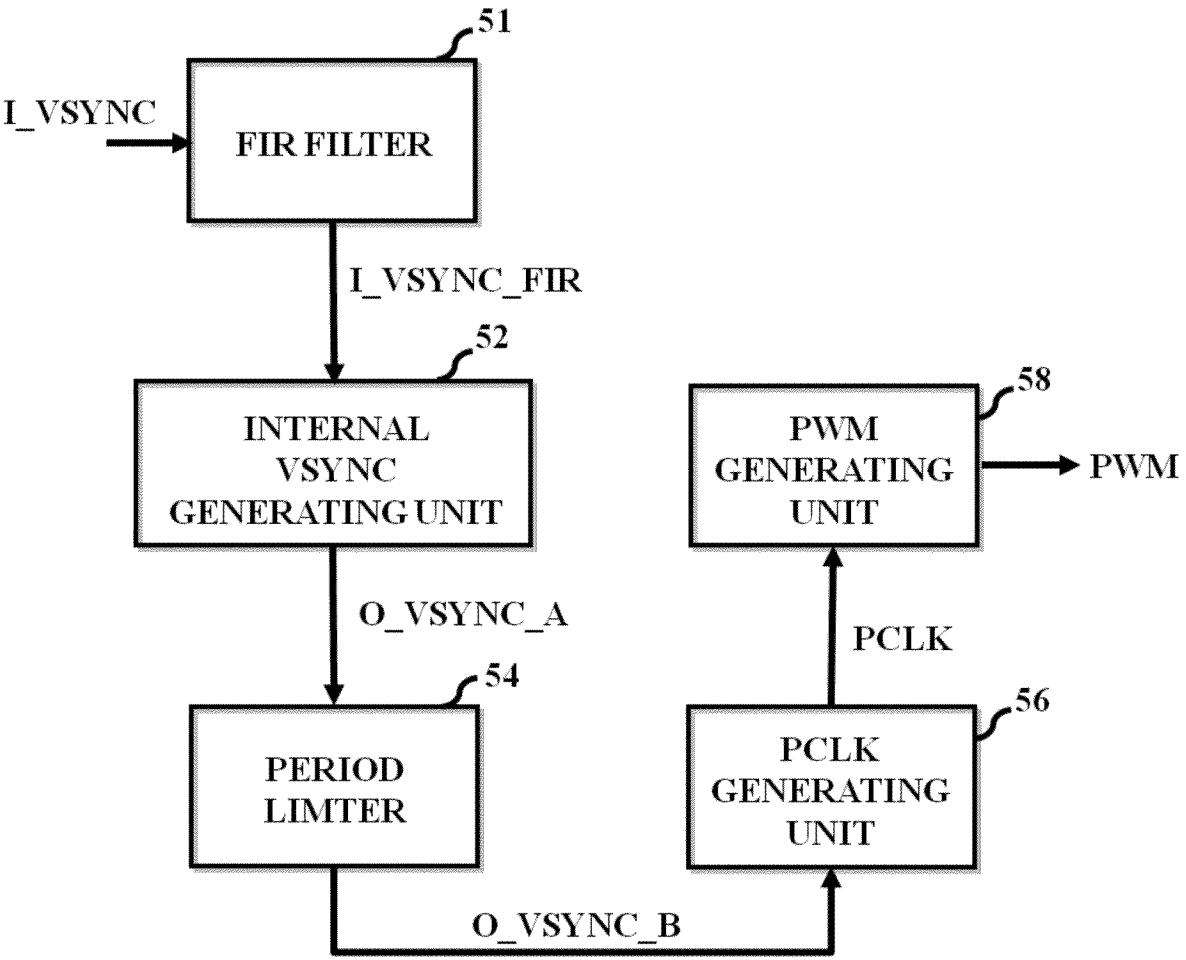
FIG. 9 is a block diagram illustrating an internal configuration of a backlight driver according to a third embodiment of the present invention.

FIG. 9 is a block diagram illustrating an internal configuration of a backlight driver according to a third embodiment of the present invention.

The backlight driver of the third embodiment illustrated in FIG. 9 is a combination of the backlight driver of the first embodiment illustrated in FIG. 2 and the backlight driver of the second embodiment illustrated in FIG. 7 and thus includes the FIR filter 51 and the period limiter respectively provided at input and output ends of the VSYNC generating unit 52. A detailed description of configurations overlapped with the above embodiments is omitted.

The FIR filter 51 outputs a filtering input period I_VSYNC_FIR, which has an average value with respect to a plurality of input periods, by applying weights to a current input period of an input VSYNC I_VSYNC and a plurality of adjacent previous input periods to reflect the results in the current input period.

The internal VSYNC generating unit 52 compares the filtering input period I_VSYNC_FIR from the FIR filter 51 with a previous output period, and generates and outputs an internal VSYNC O_VSYNC_A whose output period is set based on the comparison result.

The period limiter 54 limits an output period of the internal VSYNC O_VSYNC_A supplied from the internal VSYNC generating unit 52 within a predefined range from the previous output period, and outputs an internal VSYNC O_VSYNC_B having the limited output period. A method for limiting the output period is the same as the above description of FIG. 3.

The PCLK generating unit 56 generates and outputs internal clocks PCLK based on the output period of the internal VSYNC O_VSYNC_B supplied from the period limiter 54.

The PWM generating unit 58 generates a PWM signal having a duty ratio depending on a dimming value input from the external system or the timing controller 20 using the internal clocks PCLK supplied from the PCLK generating unit 56, and outputs the PWM signal to the backlight unit 50.

In this way, the backlight driver limits the input and output periods of the input VSYNC and the internal VSYNC using the FIR limiter 51 and the period limiter 54 respectively provided at the input and output ends of the internal VSYNC generating unit 52, thereby preventing synchronization breakage of the input VSYNC and output VSYNC when the period of the input VSYNC is periodically changed.

Figure 10:
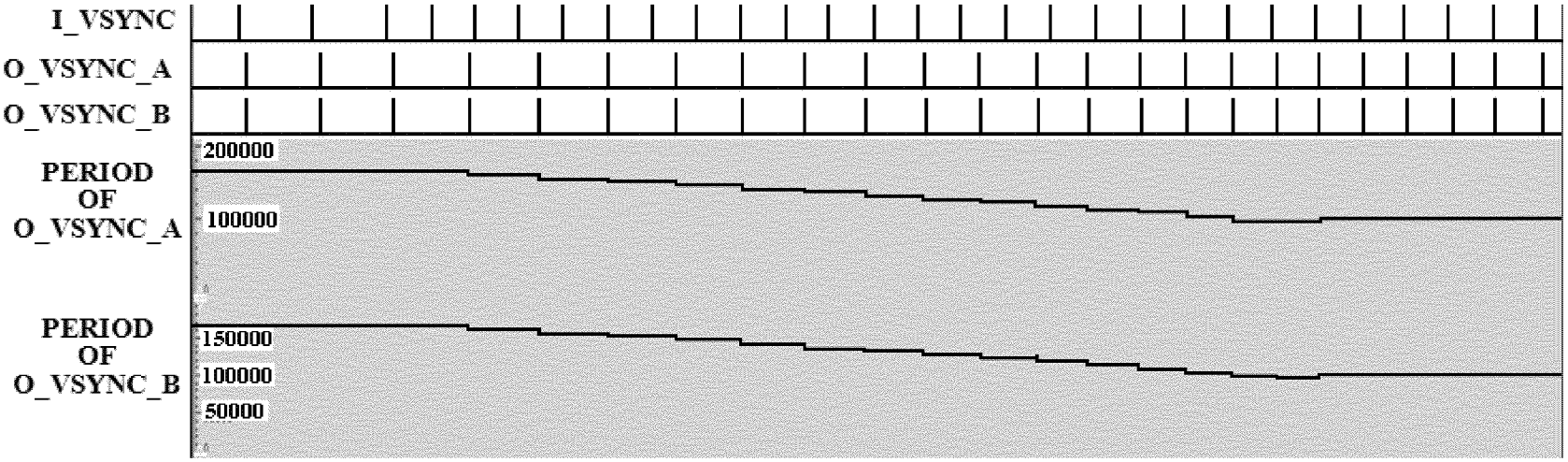
FIG. 10 is a waveform diagram illustrating synchronization of input and output synchronization signals and change of an output period in the case in which the frequency becomes fast in the backlight driver illustrated in FIG. 9.
Figure 11:
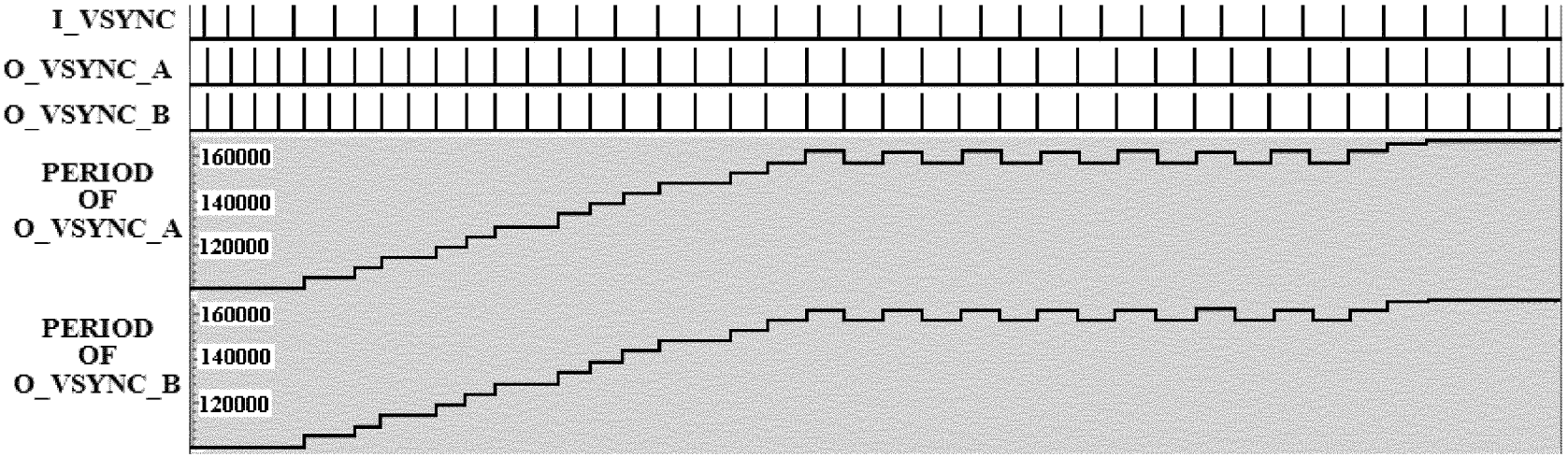
FIG. 11 is a waveform diagram illustrating synchronization of input and output synchronization signals and change of an output period in the case in which the frequency becomes slow in the backlight driver illustrated in FIG. 9.
Figure 12:
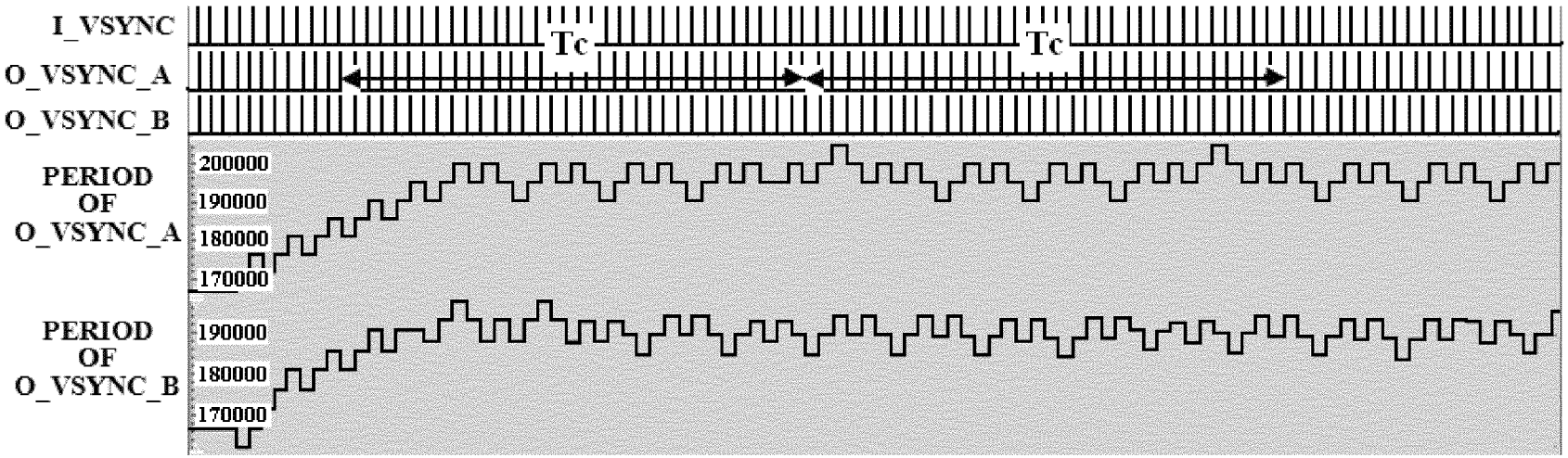
FIG. 12 is a waveform diagram illustrating synchronization of input and output synchronization signals and change of an output period in the case in which the frequency is repeatedly changed in the backlight driver illustrated in FIG. 9.

FIG. 10 is a waveform diagram illustrating synchronization of the input VSYNC and output VSYNC and change of the output period in the case in which the frequency becomes fast in the backlight driver illustrated in FIG. 9, FIG. 11 is a waveform diagram illustrating synchronization of the input VSYNC and output VSYNC and change of the output period in the case in which the frequency becomes slow in the backlight driver illustrated in FIG. 9, and FIG. 12 is a waveform diagram illustrating synchronization of the input VSYNC and output VSYNC and change of the output period in the case in which the frequency of the input VSYNC is repeatedly changed in the backlight driver illustrated in FIG. 9.

Referring to FIGS. 10 and 11, it will be appreciated that, similar to the case in which the period limiter 54 except for the FIR filter 51 limits the output period of the internal VSYNC O_VSYNC_A, as a result of limiting the input and output periods of the internal VSYNC O_VSYNC_A using the FIR filter 51 and the period limiter 54 when the input VSYNC becomes fast or slow, it is possible to achieve a relatively small change width of the period as well as synchronization of the internal VSYNC O_VSYNC_A and the input VSYNC, which may prevent flickering due to sudden change of the period. Here, with regard to the FIR filter 51 in FIG. 8, the weights a_0 and a_1 are set to ⅛, the weight a_2 is set to ¼, and the weight a_3 is set to ½.

Referring to FIG. 12. it will be appreciated that, when the input VSYNC repeatedly becomes fast or slow, i.e. when frequency change is periodically repeated, limiting only the output period of the internal VSYNC O_VSYNC_A using the period limiter 54 except for the FIR filter 51 may cause the input VSYNC and the output VSYNC to be in discord with each other by a constant period Tc. On the other hand, it will be appreciated that, when limiting both the input and output periods of the internal VSYNC O_VSYNC_A using the FIR filter 51 and the period limiter 54, the internal VSYNC O_VSYNC_B is synchronized with the input VSYNC as the period of the internal VSYNC O_VSYNC_B is repeatedly changed following that of the input VSYNC.

As is apparent from the above description, in a method and circuit for synchronizing input and output synchronization signals, a backlight driver of a liquid crystal display device using the same, and a method for driving the backlight driver according to the present invention, as a result of setting an output period based on a comparison result between an input period and a previous output period of synchronization signals and limiting input and output periods within a predefined range, it is possible to realize synchronization of input and output periods while preventing sudden change of the output period even if the input period is suddenly or repeatedly changed, and to generate and output a stabilized output synchronization signal even during synchronization. Accordingly, it is possible to prevent flickering by generating internal clocks based on the stabilized output period and stably generating a PWM signal having a desired duty ratio so as to drive a backlight unit.

Although the embodiments of the present invention describe only the method for synchronizing an input VSYNC and an internal VSYNC with each other using the backlight driver by way of example, the above described method for synchronizing the input VSYNC and the internal VSYNC with each other may be applied to other devices using VSYNC signals and may also be applied to other methods for synchronizing input and output synchronization signals except for VSYNC signals.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for synchronizing input and output synchronization signals, the method comprising:

generating an output synchronization signal whose output period is set based on a comparison result between an input period of an input synchronization signal and a previous output period of the output synchronization signal, wherein the output period of the output synchronization signal is set as a sum of the input period of the input synchronization signal and a difference between the input period of the input synchronization signal and the previous output period of the output synchronization signal; and limiting the output period of the output synchronization signal within a predefined limit range from the previous output period.

2. The method according to claim 1, wherein the limiting the output period of the output synchronization signal includes:

comparing the output period with the limit range;

maintaining and outputting the output period if the output period is within the limit range; and setting the output period to a minimum value or a maximum value of the limit range to output the set output period if the output period deviates from the limit range.

3. The method according to claim 2, wherein the limit range of the output period is preset to "the previous output period±a critical value", and the critical value is less than the previous output period.

4. The method according to claim 3, wherein:

the output period is set to the minimum value of the limit range and the output period of the minimum value is output if the output period is less than the limit range; and the output period is set to the maximum value of the limit range and the output period of the maximum value is output if the output period is greater than the limit range.

5. The method according to claim 1, wherein the generating the output synchronization signal includes:

detecting an Nth input period of the input synchronization signal, where N is a positive integer;

judging whether or not the detected Nth input period is equal to a previous N−1th input period of the output synchronization signal;

detecting a difference between an end time of the N−1th output period and an end time of the Nth input period if the detected Nth input period is not equal to the N−1th output period;

performing calculation between the detected difference and the Nth input period, and setting the calculated value to an Nth output period; and generating and outputting an output synchronization signal having the set Nth output period.

6. The method according to claim 5, after the detecting the Nth input period, further comprising:

judging whether or not the detected Nth input period is within a preset reference range; and generating and outputting an output synchronization signal having the N−1th output period if the Nth input period deviates from the reference range, wherein the method proceeds to the judging whether or not the Nth input period is equal to the N−1th output period if the Nth input period is within the reference range.

7. The method according to claim 5, further comprising setting the Nth input period to the Nth output period and outputting the Nth output period if the Nth input period is equal to the N−1th output period, wherein the setting the calculated value to the Nth output period includes:

setting a value, obtained by adding the detected difference to the Nth input period, to the Nth output period if the Nth input period becomes greater than the N−1th output period; and setting a value, obtained by subtracting the detected difference from the Nth input period, to the Nth output period if the Nth input period becomes less than the N−1th output period.

8. The method according to claim 5, wherein the Nth input period and the Nth output period of the synchronization signals have a time difference of at least one period.

9. The method according to claim 5, wherein the input period of the input synchronization signal is a filtering input period obtained by low pass filtering a plurality of adjacent input periods.

10. The method according to claim 9, wherein the filtering input period is obtained by applying weights to a current input period of the input synchronization signal and a plurality of previous input periods adjacent to the current input period respectively and summing the results.

11. A method for synchronizing input and output synchronization signals, the method comprising:

low pass filtering a plurality of adjacent input periods of an input synchronization signal to output a filtering input period; and generating an output synchronization signal whose output period is set based on a comparison result between the filtering input period and a previous output period of the output synchronization signal, wherein the output period of the output synchronization signal is set as a sum of the filtering input period and a difference between the filtering input period and the previous output period of the output synchronization signal.

12. The method according to claim 11, wherein the filtering input period is obtained by applying weights to a current input period of the input synchronization signal and a plurality of previous input periods adjacent to the current input period respectively and summing the results.

13. A circuit for synchronizing input and output synchronization signals, the circuit comprising:

an internal synchronization signal generating unit to generate an output synchronization signal whose output period is set based on a comparison result between an input period of an input synchronization signal and a previous output period of the output synchronization signal, wherein the output period of the output synchronization signal is set as a sum of the input period of the input synchronization signal and a difference between the input period of the input synchronization signal and the previous output period of the output synchronization signal; and a period limiter to limit the output period of the output synchronization signal within a predefined limit range from the previous output period.

14. The circuit according to claim 13, wherein the period limiter compares the output period with the limit range, maintains and outputs the output period if the output period is within the limit range, and sets the output period to a minimum value or a maximum value of the limit range to output the set output period if the output period deviates from the limit range.

15. The circuit according to claim 14, wherein the limit range of the output period is preset to "the previous output period±a critical value", and the critical value is less than the previous output period.

16. The circuit according to claim 15, wherein:

the output period is set to the minimum value of the limit range and the output period of the minimum value is output if the output period is less than the limit range; and the output period is set to the maximum value of the limit range and the output period of the maximum value is output if the output period is greater than the limit range.

17. The circuit according to claim 13, wherein the internal synchronization signal generating unit detects an Nth input period of the input synchronization signal, where N is a positive integer, judges whether or not the detected Nth input period is equal to a previous N−1th input period of the output synchronization signal, detects a difference between an end time of the N−1th output period and an end time of the Nth input period if the detected Nth input period is not equal to the N−1th output period, performs calculation between the detected difference and the Nth input period, sets the calculated value to an Nth output period, and generates and outputs the output synchronization signal having the set Nth output period.

18. The circuit according to claim 17, wherein:

the internal synchronization signal generating unit judges whether or not the detected Nth input period is within a preset reference range after the detecting the Nth input period; and the internal synchronization signal generating unit generates and outputs the output synchronization signal having the N−1th output period if the Nth input period deviates from the reference range, and judges whether or not the Nth input period is equal to the N−1th output period if the Nth input period is within the reference range.

19. The circuit according to claim 18, wherein:

the internal synchronization signal generating unit sets the Nth input period to the Nth output period to output the Nth output period if the Nth input period is equal to the N−1th output period;

the internal synchronization signal generating unit sets a value, obtained by adding the detected difference to the Nth input period, to the Nth output period if the Nth input period becomes greater than the N−1th output period; and the internal synchronization signal generating unit sets a value, obtained by subtracting the detected difference from the Nth input period, to the Nth output period if the Nth input period becomes less than the N−1th output period.

20. The circuit according to claim 17, wherein the Nth input period and the Nth output period of the synchronization signals have a time difference of at least one period.

21. The circuit according to claim 17, further comprising a low pass filter to supply the input period, which is a filtering input period obtained by low pass filtering a plurality of adjacent input periods of the input synchronization signal, to the internal synchronization signal generating unit.

22. The circuit according to claim 21, wherein the low pass filter is a finite impulse response (FIR) filter which applies weights to a current input period of the input synchronization signal and a plurality of previous input periods adjacent to the current input period respectively and summing the results.

23. A circuit for synchronizing input and output synchronization signals, the circuit comprising:

a low pass filter to perform low pass filtering of a plurality of adjacent input periods of an input synchronization signal to output a filtering input period; and an internal synchronization signal generating unit to generate an output synchronization signal whose output period is set based on a comparison result between the filtering input period and a previous output period of the output synchronization signal, wherein the output period of the output synchronization signal is set as a sum of the filtering input period and a difference between the filtering input period and the previous output period of the output synchronization signal.

24. The circuit according to claim 23, wherein the low pass filter is a finite impulse response (FIR) filter which applies weights to a current input period of the input synchronization signal and a plurality of previous input periods adjacent to the current input period respectively and summing the results.

25. A circuit for synchronizing input and output synchronization signals, the circuit comprising:

an internal synchronization signal generating unit configured to detect an input synchronization signal on a per period basis and compare the detected input period with a previous output period in order to generate and output an internal output synchronization signal whose output period being set based on the comparison result, wherein the output period of the output synchronization signal is set as a sum of the input period of the input synchronization signal and a difference between an input period of the input synchronization signal and the previous output period of the output synchronization signal; and a period limiter configured to limit the output period of the internal output synchronization signal within a predefined limit range from the previous output period in order to prevent the internal output synchronization signal from being suddenly changed due to frequency change of the input synchronization signal.

* * * * *